United States Patent [19]

Fujino et al.

[11] Patent Number: 4,842,038

[45] Date of Patent: Jun. 27, 1989

[54] INJECTION METHOD OF DIE CASTING MACHINE

[75] Inventors: Kiyoshi Fujino; Toyoaki Ueno, both of Yamaguchi, Japan

[73] Assignee: UBE Industries, Inc., Yamaguchi, Japan

[21] Appl. No.: 163,208

[22] Filed: Feb. 26, 1988

Related U.S. Application Data

[63] Continuation of Ser. No. 932,718, Nov. 19, 1986, abandoned.

[30] Foreign Application Priority Data

Nov. 26, 1985 [JP] Japan ..... 60-263758
Mar. 10, 1986 [JP] Japan ..... 61-50450

[51] Int. Cl.[4] ..... B22D 17/00; B22D 23/06

[52] U.S. Cl. ..... 164/80; 164/113; 164/312; 164/512; 164/514; 164/493; 164/494

[58] Field of Search ..... 164/80, 113, 119, 250–251, 164/303–318, 492–494, 512, 513, 48, 495, 511, 514, 136

[56] References Cited

U.S. PATENT DOCUMENTS 4,347,889 9/1982 Komatsu et al. ..... 164/250.1

FOREIGN PATENT DOCUMENTS 57-11760 1/1982 Japan ..... 164/80

*Primary Examiner*—Richard K. Seidel
*Attorney, Agent, or Firm*—Blakely, Sokoloff, Taylor & Zafman

[57] ABSTRACT

In an injection method of a die casting machine of the invention, an inner portion of a billet, excluding peripheral and bottom portions thereof, is melted in advance. The billet with the molten inner portion is supplied into an injection sleeve. The injection sleeve is then externally heated to melt the entire portion of the billet. The molten metal is injected into a die cavity.

13 Claims, 3 Drawing Sheets

INJECTION METHOD OF DIE CASTING MACHINE

BACKGROUND OF THE INVENTION

The present invention relates to an injection method of a die casting machine for injecting a molten metal into a die cavity.

Die casting machines are classified into those of a vertical casting type and those of a horizontal casting type in accordance with the injection direction of a molten metal into a die cavity. An injection device of a die casting machine of a vertical casting type has a stationary sleeve, split into two semicylinders and fitted under a die cavity, for opening/closing together with a die, an injection sleeve detachably connected to the lower end of the clamped stationary sleeve, and an injection cylinder, which has an injection plunger fitted in the injection sleeve to be vertically movable by a hydraulic pressure, and which stands upright, is inclined, or horizontally moves in the upright state together with the injection sleeve. According to a conventional casting method using such an injection device, a plurality of billets are melted in a melting furnace. A molten metal in a holding furnace is cast into an injection sleeve, separated from a stationary sleeve and inclined together with an injection cylinder, by an automatic casting unit or a manual ladle. Upon casting, the injection sleeve is moved together with the injection cylinder and is connected to the stationary sleeve. Then, the injection plunger is moved upward by a hydraulic pressure, so that the molten metal in the injection sleeve is injected into the die cavity through the stationary sleeve.

With the conventional injection method, however, a large melting furnace, a holding furnace, an automatic casting unit and so on are required. Therefore, installation and maintenance costs are high, a large space is required, and energy loss is large since it is difficult to set the injection amount of the molten metal constant in each injection.

When a plurality of billets are melted, a large quantity of gas is generated. Also, since a large amount of molten metal is held in air and the molten metal is carried in air from the melting furnace to the holding furnace, impurities such as oxides form on the surface of the molten metal, and impurities are mixed in from the ambient environment. The molten metal casting amounts in the injection step vary, and a gas inclusion occurs. These problems degrade the productivity and quality of the products.

SUMMARY OF THE INVENTION

It is an object of the present invention to provide an injection method of a die casting machine which is free from the drawbacks in the conventional technique described above.

The injection method of a die casting machine according to the present invention comprises the steps of preparing billets each having a size required for a single injection, melting an inner portion of the billet in advance excluding peripheral and bottom portions thereof, melting an entire portion of the billet in an injection sleeve, and injecting a resultant material into a die cavity.

DETAILED DESCRIPTION OF THE PREFERRED EMBODIMENTS

The present invention will be described in detail with reference to the accompanying drawings.

Figure 1:
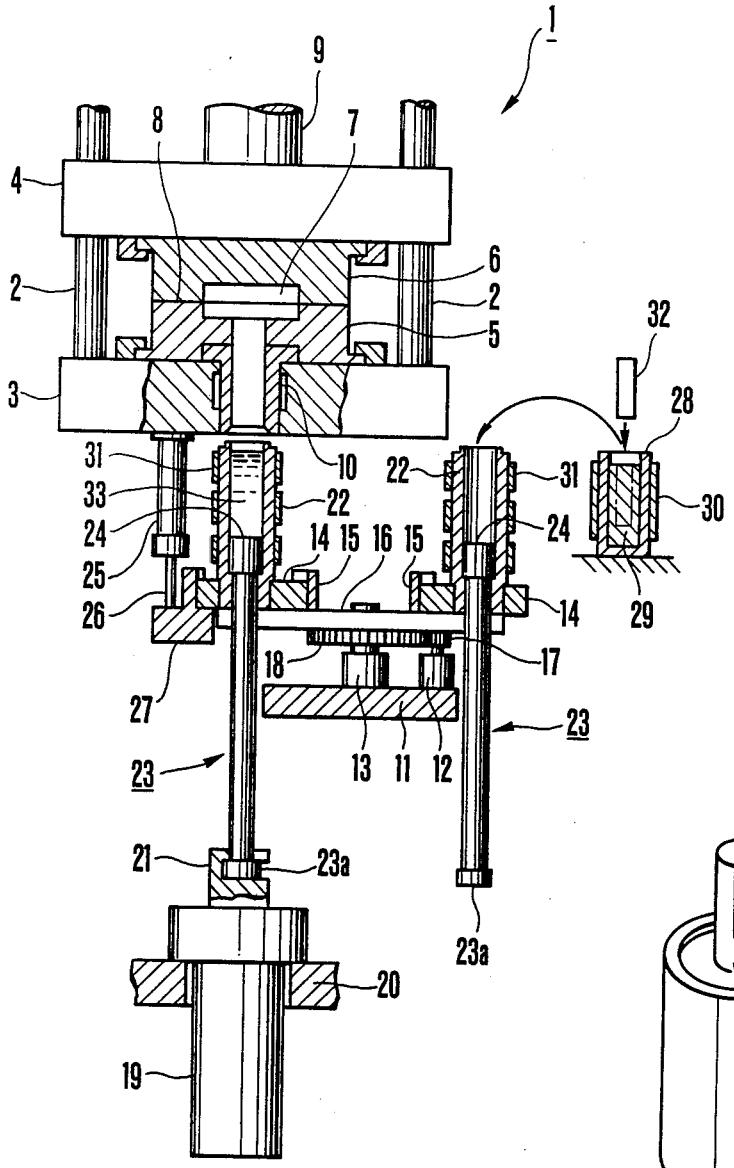
FIG. 1 is a longitudinal sectional view of a rotary-type injection device of a die casting machine for explaining an injection method of a die casting machine according to an embodiment of the present invention.

A die casting machine 1 shown in FIG. 1 has a pair of vertical stationary plates 3 (the upper plate is not shown) coupled with each other at four corners by tie rods 2. A movable plate 4 is supported on the tie rods 2 to be vertically movable such that its four corners are fitted with the tie rods. Stationary and movable dies 5 and 6 are mounted in the stationary and movable plates 3 and 4, respectively. Cavities 7 are formed in the dies 5 and 6 with their split surfaces 8 as a boundary. A piston rod 9 of a clamping cylinder fixed on the upper stationary plate is fixed on the movable plate 4. When the piston rod 9 is moved forward/backward by a hydraulic pressure, the dies 5 and 6 are clamped/opened. A cylindrical stationary sleeve 10 is fitted in the stationary plate 3. The flange of the stationary sleeve 10 is engaged with the interior of the stationary die 5. The inner hole of the stationary sleeve 10 communicates with the cavity 7.

A frame 11 is located under the stationary plate 3 to be fixed to the stationary plate 3 side. A motor 12 and a bearing 13 are fixed on the frame 11. The bearing 13 rotatably supports a rotating table 16. Sleeve tables 14 are supported on the two end portions of the rotating table 16 to be vertically movable through a guide 15. A pinion 17 axially mounted on the motor shaft of the motor 12 engages with a gear 18 fixed on the rotating table 16. When the motor 12 is driven, the rotating table 16 is alternately pivoted clockwise and counterclockwise through 180°, and the sleeve tables 14 are alternately brought to the position immediately under the stationary sleeve 10. An injection cylinder 19 is supported by a stationary plate 3 side frame 20 and is located immediately under the stationary sleeve 10 to be concentric therewith. The piston rod of the injection cylinder 19 is moved forward/backward by a hydraulic pressure. A U-shaped coupling 21 is fixed on the operating end of the piston rod of the injection cylinder 19. A pair of cylindrical injection sleeves 22 are fitted in the central holes of the sleeve tables 14, respectively, and have inner holes having substantially the same diameter as the stationary sleeve 10. Plunger tips 24 as head portions of injection plungers 23 are slidably fitted in the inner holes of the injection sleeves 22. Flanges **23*a* are provided at the lower ends of the injection plungers 23. When either of the plungers 23 is at a lowest point and the corresponding injection sleeve 22 is pivoted to be concentric with the injection cylinder 19, the corresponding flange 23***a* is engaged with the coupling 21. A shift cylinder 25 is mounted on the lower surface of the stationary plate 3. A shifter 27 is fixed to an operating end of a piston rod 26 of the shift cylinder 25. When the flange 23*a* is engaged with the coupling 21, a groove of the shifter 27 is engaged with the sleeve table 14 to move the piston rod 26 forward/backward, thereby vertically moving the corresponding injection sleeve 22. The injection sleeves 22 are at the lowest position in FIG. 1. When either of the injection sleeve 22 is moved upward from this state, it is connected with the stationary sleeve 10 with its inner hole communicated to the inner hole of the latter.

A cylindrical preheater 28 is arranged at an outer position in the vicinity of the injection sleeves 22 having the above arrangement. For example, an aluminum billet 29 or a billet 29 containing a mixture such as ceramic fibers formed to have a predetermined size matching with a single injection amount is put in the preheater 28. A heater 30 such as an induction heater or a resistor heater is mounted on the outer surface of the preheater 28. Heaters 31 such as induction heaters or resistor heaters are mounted on the outer surface of each injection sleeve 22. The temperatures of the heaters 31 are set to be higher than that of the heater 30. A carbon electrode 32 or a melting jig which is vertically movable, such as a plasma melting jig, is arranged above the preheater 28. When the carbon electrode 32 or the melting jig is moved downward to a central portion of the billet 29, the inner portion of the billet 29 excluding its peripheral and bottom portions is melted. After the inner portion of the billet 29 is melted, the billet 29 is carried into an injection sleeve 22 and is heated and melted by the corresponding heaters 31. A molten metal 33 is obtained by melting the billet 29. When the table 16 is rotated and the corresponding plunger tip 24 is moved upward, the molten metal 33 is injected into the cavity 7.

An injection method of the die casting machine having the above-described rotary-type injection device will be described.

A billet 29 having a size required for a single injection is supplied to the preheater 28 and is externally heated by the heater 30 to about 450 to 500° C. The carbon electrode 32 is moved downward to the central portion of the billet 29, and the billet 29, excluding its peripheral and bottom portions, is melted. This billet 29 is moved into the outer-side injection sleeve 22 and is heated by the corresponding heater 31. Since the billet 29 is preheated and melted in advance, it is melted into a molten metal 33 within a short period of time. When the motor 12 is driven in the forward direction, the rotating table 16 is pivoted through 180°, the injection sleeve 24 containing the molten metal 33 is moved to a position immediately under the stationary sleeve 10, and the flange 23*a* of the plunger 23 is engaged with the coupling 21. Then, when the piston rod 26 of the injection cylinder 19 is moved upward by a hydraulic pressure, the sleeve table 14 engaged with the shifter 27 is moved upward along the guide 15, and the injection sleeve 22 is tightly urged against and connected to the stationary sleeve 10. Subsequently, the piston rod of the injection cylinder 19 is moved forward to move the plunger 23 engaged with the coupling 21 upward, and the molten metal 33 is pushed upward by the plunger tip 24 and injected into the cavity 7. After the molten metal 33 in the cavity is solidified, the movable die 6 is opened and the product is picked up. The plunger 23 and the injection sleeve 22 are moved downward to the positions shown in FIG. 1.

While a molten metal 33 in one injection sleeve 22 is being injected, the other injection sleeve 22 is stopped at the outer position. During this period, the billet 29 in the heater 28 is preheated to melt its inner portion and subsequently the billet 29 in the injection sleeve 22 is melted. When injection from one injection sleeve 22 is finished, a molten metal 33 is prepared in the other injection sleeve 22. Therefore, a next injection can be started immediately by pivoting the rotating table 16 counterclockwise through 180°.

Regarding melting of the billet 29 in the injection sleeve, a high thermal efficiency can be obtained if the opening of the injection sleeve 22 is closed by a cover. A higher thermal efficiency can be obtained if the interior of the injection sleeve 22 is evacuated. If the preheating section, the melting section, and the entire portion of the injection section are placed in a vacuum generating chamber, preheating, melting, and injection can be performed in vacuum. This embodiment exemplifies a rotary-type injection device of a die casting machine. However, a pair of injection sleeves can be provided. In this case, injection sleeves after injection are alternately, linearly moved to the two sides of the injection position, and billet 29 is melted. Two injection devices each having an injection cylinder, an injection sleeve, and a preheat unit, can be provided and rotated or horizontally moved, as in the above embodiment. Although the present invention can also be embodied by a general injection device having one injection sleeve, it is more effective if two injection sleeves 22 are provided in order to shorten a casting cycle.

In this embodiment, a heater rod or columnar heater covered with a protective tube may be used in place of the carbon electrode 32.

Figure 2:
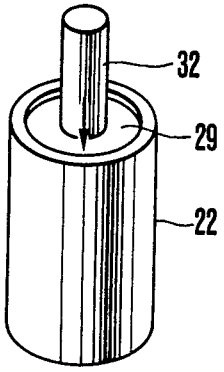
FIG. 2 is a perspective view for explaining a step of preheating a billet.
Figure 3:
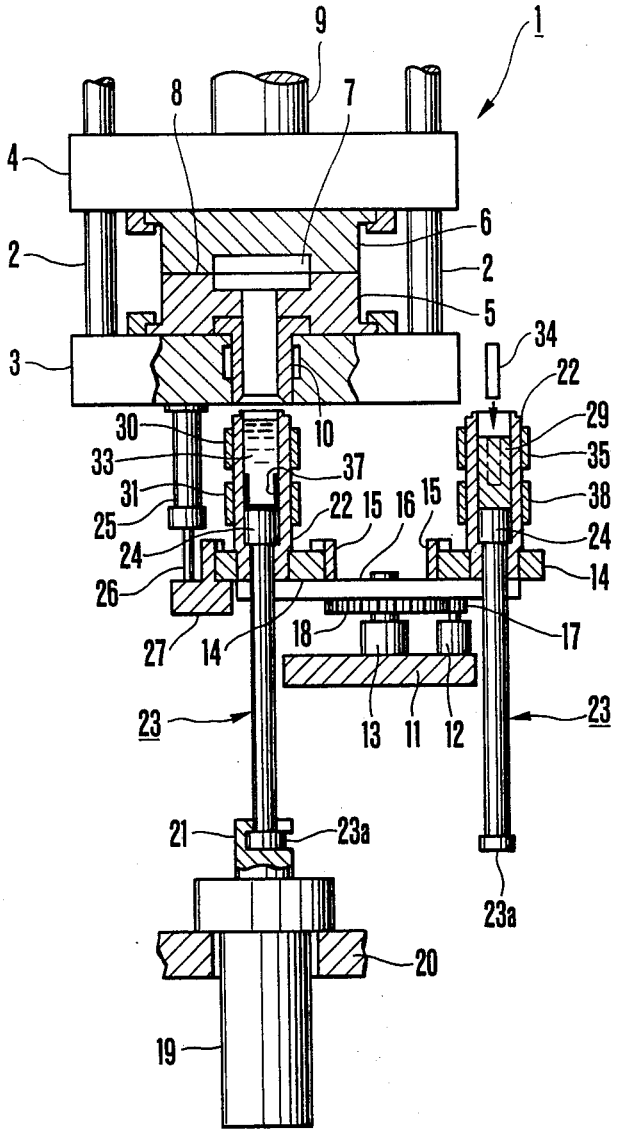
FIG. 3 is a sectional view for explaining another embodiment of the present invention.
Figure 4:
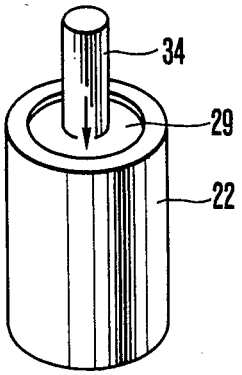
FIG. 4 is a perspective view for explaining a step of heating a central portion of a billet.

FIGS. 3 and 4 are views for explaining another embodiment of the present invention. The same reference numerals in FIGS. 3 and 4 denote the same or equivalent portions as in FIGS. 1 and 2, respectively.

In this embodiment, a billet 29 having a size required for a single injection is supplied when an injection sleeve 22 is at an outer position rotated through 180° from the position immediately under a stationary sleeve 10. The billet 29 is supplied to the injection sleeve 22. A melting jig 34, such as a carbon electrode, a columnar heater covered with a ceramic, or a plasma melting jig, which is vertically movable, is arranged immediately above the injection sleeve 22. When the melting jig 34 is gradually moved downward to the central portion of the billet 29, as indicated by an arrow in the drawings and is held there for a predetermined period of time, the inner portion of the billet, excluding its peripheral and bottom portions, is melted. A pair of heaters 35 and 36 such as vertical induction heaters or resistor heaters are mounted on each injection sleeve 22. The temperature of the upper heater 35 is set high in order to heat and melt the billet 29. However, the temperatures of the lower heater 36 and a plunger tip 24 are set to be lower than the melting point of the billet 29. More specifically, the temperature of the injection sleeve 22 around the portion where the upper surface of a plunger tip 24 and the lower surface of the billet 29 contact, which corresponds to the temperature of a portion where it contacts the outer lower surface of a material to be injected at a pre-injection position, and/or the point of the plunger tip 24 is maintained to be lower than the melting point of the material to be injected. With this temperature setting, assume that the billet 29 is melted from inside by the melting jig 34, the melting jig 34 is moved upward, the injection sleeve 22 is moved to a position immediately under the stationary sleeve 10, and heating by the heaters 35 and 36 is continued. Then, the billet is melted into a molten metal. Since the heater 36 and the plunger tip 24 are at a low temperature and the billet 29 is melted from inside, a cylindrical solid layer 37 with a bottom is formed on the lower inner wall of the injection sleeve 22 and the upper end face of the plunger tip 24. The solid layer 37 prevents the molten metal from penetrating into a narrow gap between the injection sleeve 22 and the plunger tip 24.

An injection method of a die casting machine having the rotary-type injection device with the above arrangement will be described.

A billet 29 having a size required for a single injection is supplied into an injection sleeve 22 at an outer position and is externally heated by the heaters 35 and 36. When a melting jig 34 is moved downward to the central portion of the billet 29, the billet 29 is melted from inside excluding its peripheral and bottom portions. The melting jig 34 is then moved upward while the heaters 35 and 36 keep heating, and a motor 12 is driven in the forward direction. Then, a rotating table 16 is pivoted through 180° to bring the injection sleeve 22 to a position immediately under the stationary sleeve 10, and a flange 23*a* of a plunger 23 is engaged with a coupling 21. Subsequently, a piston rod 26 of an injection cylinder 19 is moved upward by a hydraulic pressure to move a corresponding sleeve table 14, engaged with a shifter 27, upward along a guide 15, and is urged against the stationary sleeve 10 to be connected thereto. In this case, the billet 29 is melted from inside into a molten metal 33. Since the billet 29 is melted from inside and the heaters 35 and 36 and the plunger tip 24 are set at a low temperature, a solid layer 37 having a thickness of 0.1 to 1 mm is formed on the lower inner surface of the injection sleeve 22 and on the upper end surface of the plunger tip 24. A gap of about 0.005 mm exists between the inner diameter of the injection sleeve 22 and the outer diameter of the plunger tip 24. However, because of the presence of the solid layer 37, the molten metal 33 does not leak from this gap. When the piston rod of the injection cylinder 19 is moved forward, the plunger 23 engaged with the coupling 21 is moved upward, and the molten metal 33 is pushed upward by the plunger tip 24 and injected into the cavity 7. When the molten metal 33 in the cavity 7 is solidified, a movable die 6 is opened and the product is picked up. The plunger 23 and the injection sleeve 22 are moved downward to the positions shown in FIG. 3.

In this manner, while a molten metal 33 in one injection sleeve 22 is being injected, the other injection sleeve 22 is stopped at an outer position. Assume that a next billet 29 is supplied to the stopped injection sleeve 22 and is melted from inside by the melting jig 34 and is heated by the heaters 35 and 36. In this case, when injection from one injection sleeve 22 is finished, a molten metal 33 is prepared in the other injection sleeve 22. Therefore, a next injection can be started immediately by pivoting the rotating table counterclockwise through 180°.

In this embodiment, the billet 29 is supplied directly to the injection sleeve 22 and is heated and melted. However, a billet preheating unit can be provided at an outer position in the vicinity of the injection sleeve 22, as in the embodiment shown in FIG. 1. In this case, when a billet 29 whose inner portion is melted and outer portion is preheated is conveyed to an injection sleeve 22, the billet can be sufficiently melted during injection by the other injection sleeve 22, thus shortening the injection cycle.

A ring with a slight inward projection or a recessed ring groove may be arranged on an upper portion of or a portion of the stationary sleeve 10 immediately before the cavity 7 in order to prevent part of the solid layer 37 from being cast into the cavity 7. Furthermore, a horizontal die clamping unit as well as a vertical die clamping unit can be used.

Figure 5:
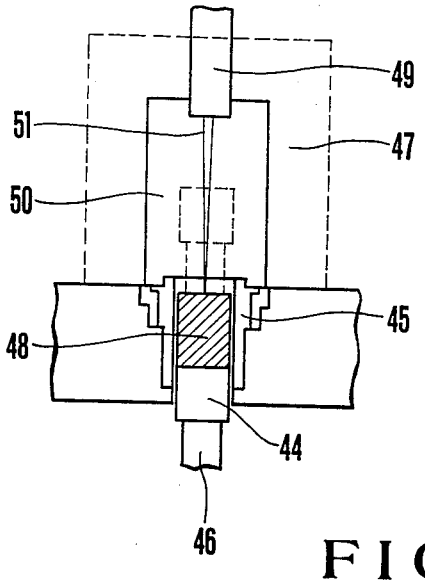
FIG. 5 is a sectional view for explaining still another embodiment of the present invention.
Figure 6:
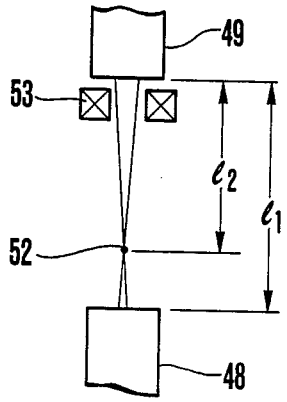
FIG. 6 is a view for explaining conditions for experiments.

FIG. 5 is a view for explaining still another embodiment of the present invention.

Referring to FIG. 5, when a plunger rod 46 and a plunger tip 44 are moved downward, a space is formed in a sleeve 45. A billet 48 is supplied in the space utilizing a billet supply unit (not shown). Subsequently, an electron gun 49 is moved to a position above the billet 48 and a vacuum chamber 50 is arranged as shown in FIG. 5. Since an electron beam 51 from the electron gun 49 can be deflected by a deflection lens or the like, the position of the electron gun 49 can be freely selected within a range capable of deflecting. When the interior of the chamber 50 is set at an appropriate vacuum pressure e.g., 1,000 Torr, the electron beam 51, whose output can be automatically changed in accordance with the melting state, is emitted to instantaneously, completely melt the billet 48 and hold it. Then, the electron beam melting unit (49, 50, and 51) is quickly removed, and a die 47 is placed on the sleeve 45. Simultaneously the plunger rod 46 and the plunger tip 44 are moved upward, and a molten metal is cast in the die 47, thus molding a product.

Table I shows experimental results for determining a time required for completely melting billets by the electron beam when columnar billets of various sizes are put in the sleeve 45, ab is fixed at a value larger than 1.0, and the accelerating voltage and the electron beam current are changed. Note that ab is a ratio of a distance l1 between an electron beam emitting port of the electron gun 49 and the billet 48 to a distance l2 between the emitting port and a focal point 52 of the electron beam. The focal point 52 changes in accordance with the change in the current flowing through an electromagnetic coil 53. In Table I, ab>0 when the focal point 52 is higher than the surface of the billet 48.

TABLE I

| Billet | | Time for Complete Melting | Oxide | Electron Beam Current | Beam Output |
|---|---|---|---|---|---|
| Material | Size | (sec) | Inclusion | (mA) | (kW) |
| AC4CH | 30ϕ × 30 | 4.5–6.4 | Absent | 200 | 14 |
| AC4CH | 30ϕ × 30 | 2.2–4.6 | Absent | 400 | 28 |
| AC4CH | 50ϕ × 50 | 20–30 | Absent | 200 | 14 |
| AC4CH | 50ϕ × 50 | 11–22 | Absent | 400 | 28 |

Conditions:
(1) ab = l1/l2 ≈ 1.2
(2) Accelerating voltage: 70 kV
(3) Beam scan: Stable or oscillating It is apparent from this experiment that the billet can be instantaneously, efficiently melted and no oxide or gas inclusions are found in the cast metal, thus achieving high-quality melting.

In this embodiment, electron beam radiation is performed by using the vacuum chamber 50. However, the present invention is not limited to this. Electron beam radiation can be performed in air.

Also, the billet 48 can be preheated and subjected to electron beam radiation.

In this embodiment, a high energy-density beam, such as a laser beam, may be used in place of the electron beam.

As is apparent from the above description, according to the injection method of the die casting machine of the present invention, no melting furnace, holding furnace, or automatic casting unit is required, thus greatly reducing the installation and maintenance costs. Since the volumes of the billets can be easily set to be the same, a molten metal of a constant amount can be injected in every injection. Also, impurities may not be formed nor mixed in from the ambient environment, thus improving and stabilizing the quality of the product. When one billet is melted in one injection sleeve while the other billet is being injected from the other injection sleeve, the casting cycle is shortened. Furthermore, since a solid layer of the molten metal forms on the lower portion of the inner hole of the injection sleeve, leakage of the molten metal as well as dragging by the plunger tip can be prevented.

What is claimed is:

1. An injection method of a die casting machine, comprising the steps of preparing billets each having a size required for a single injection, melting an inner portion of the billet in advance excluding peripheral and bottom portions thereof, melting an entire portion of the billet in an injection sleeve, and injecting a resultant material into a die cavity.

2. A method according to claim 1, wherein the inner portion of the billet is melted by gradually moving a melting jig downward to a central portion of the billet.

3. A method according to claim 1, wherein the step of melting the inner portion of the billet comprises the step of irradiating an electron beam onto a portion inside a peripheral surface of the billet.

4. A method according to claim 3, wherein the step of irradiating the electron beam comprises the step of adjusting a focal point of the electron beam to be located before a surface of the billet.

5. A method according to claim 4, wherein the step of irradiating the electron beam comprises the step of adjusting a focal point of the electron beam to be located before a surface of the billet.

6. A method according to claim 4, wherein the step of irradiating the electron beam is performed by oscillating or moving the beam on a surface of the billet.

7. A method according to claim 4, wherein the step of irradiating the electron beam comprises the step of evacuating an electron beam radiation atmosphere.

8. An injection method of a die casting machine, comprising the steps of: (a) loading a billet having a size required for a single injection in an injection sleeve which is kept at a temperature that is lower than the melting point of said billet, (b) melting an inner portion of said billet into a molten metal so as to leave a solid layer at bottom and peripheral portions of said billet which contains said molten metal of said inner portion, and (c) injecting said molten metal into a die cavity.

9. An injection method of a die casting machine comprising the steps of: (a) preheating a billet having a size required for a single injection, said preheating performed outside an injection sleeve, (b) melting an inner portion of said billet to a predetermined temperature so as to leave a solid layer which contains said molten inner portion of said billet therein, (c) loading said billet in said injection sleeve, (d) heating said billet until said billet is substantially molten, and (e) injecting said molten billet into a die cavity.

10. An injection method of a die casting machine, comprising the steps of sequentially moving a plurality of injection sleeves to a position immediately under a stationary sleeve, loading a billet whose inner portion, excluding a peripheral and bottom portions thereof, is melted in advance in one of said injection sleeves, externally heating said injection sleeve to melt said billet into a molten metal, and injecting said molten metal into a die.

11. A method according to claim 10, wherein the inner billet melting step comprises gradually moving a cylindrical melting jig downward to a central portion of said billet.

12. A method according to claim 10, wherein the inner billet melting step comprises irradiating an electron beam to a central portion of said billet.

13. An injection method of a die casting machine comprising the steps of: (a) melting an inner portion of a billet having a size required for a single injection so that said billet is brought into a condition such that said inner portion is molten metal but bottom and lower peripheral portions of said billet form a solid layer containing therein the molten metal of the inner portion, said melting performed in an injection sleeve when said injection sleeve is in a position which is different from an injection position, (b) moving said injection sleeve containing said billet to said injection position, and (c) injecting said molten metal into a die cavity.

* * * * *